US006554098B1

(12) United States Patent
Komura

(10) Patent No.: US 6,554,098 B1
(45) Date of Patent: Apr. 29, 2003

(54) PANEL SPEAKER WITH WIDE FREE SPACE

(75) Inventor: Tatsumi Komura, Tokyo (JP)

(73) Assignee: NEC Corporation, Tokyo (JP)

( * ) Notice: Subject to any disclaimer, the term of this patent is extended or adjusted under 35 U.S.C. 154(b) by 183 days.

(21) Appl. No.: 09/584,389

(22) Filed: Jun. 1, 2000

(30) Foreign Application Priority Data

Jun. 15, 1999 (JP) ..... 11-168887

(51) Int. Cl.[7] ..... G10K 13/00
(52) U.S. Cl. ..... 181/173
(58) Field of Search ..... 181/166, 173, 181/157, 164, 167, 171, 175

(56) References Cited

U.S. PATENT DOCUMENTS

| | | | | |
|---|---|---|---|---|
| 3,835,265 A | * | 9/1974 | Itagaki | 181/157 |
| 4,252,211 A | * | 2/1981 | Matsuda et al. | 181/166 |
| 5,025,474 A | | 6/1991 | Tanaka et al. | 381/90 |
| 5,484,969 A | * | 1/1996 | McKendree et al. | 181/142 |
| 5,761,322 A | * | 6/1998 | Illingsworth | 381/188 |

FOREIGN PATENT DOCUMENTS

| | | |
|---|---|---|
| GB | 931080 | 7/1963 |
| GB | 2 082 021 A | 2/1982 |
| JP | 58-210800 | 12/1983 |
| JP | 2-170795 | 7/1990 |
| JP | 4-150298 | 5/1992 |
| JP | 4-287500 | 10/1992 |
| JP | 2570679 | 10/1996 |
| KR | 0016382 | 9/1983 |
| KR | 0044100 | 7/1989 |
| WO | WO 97/09846 | 3/1997 |
| WO | WO 99/37121 | 7/1999 |
| WO | WO 00/02417 | 1/2000 |
| WO | WO 00/13464 | 3/2000 |
| WO | WO 00/35242 | 6/2000 |

* cited by examiner

*Primary Examiner*—Kim Lockett
(74) *Attorney, Agent, or Firm*—Sughrue Mion, PLLC

(57) ABSTRACT

A panel speaker includes an acoustic vibrating plate, and a vibration driver mounted off a center of the acoustic vibrating plate and applying vibration to the acoustic vibrating plate. A control unit may be provided to control the vibration driver to apply vibration to the acoustic vibrating plate.

23 Claims, 25 Drawing Sheets

100

100'

PANEL SPEAKER WITH WIDE FREE SPACE

BACKGROUND OF THE INVENTION

1. Field of the Invention

The present invention relates to a loudspeaker, and more particularly to a panel speaker with a wide free space in various applications such as a thin panel type, a wall mounted type, a picture stand type, and a vehicle mounted type.

2. Description of the Related Art

A conventional panel speaker is provided with an acoustic vibrating plate used as a panel, which can emit sounds when being driven by a vibration driver. Such a panel speaker is known in Japanese Patent Laid Open Patent Application (JP-A-Showa 58-210800), as shown in FIG. 1. In this conventional example, a vibration driver 2 is mounted in substantially the center of an acoustic vibrating plate 1 to apply vibration to the acoustic vibrating plate in a thickness direction of the vibrating plate 1.

FIGS. 5 and 6 illustrate profiles of simulation of the acoustic vibrating plate 1 when the center of the acoustic vibrating plate 1 is driven by the vibration driver 2 at frequencies of 5 kHz and 15 kHz, respectively. In the figures, arrows indicate the direction of vibration applied by the vibration driver 2, and the amplitude of vibration of the acoustic vibrating plate 1 is exaggerated.

Also, another conventional panel speaker is disclosed in Japanese Patent Laid Open Patent Application (JP-A-Heisei 4-150298). In this reference, a single vibration driver is mounted on substantially the center of the acoustic vibrating plate, or a plurality of vibration drivers are mounted substantially in symmetry with respect to the center of the acoustic vibrating plate. In addition, the thin panel speaker is used for a picture frame. As the panel speaker is assembled to function as a hold-down plate at the back side of a picture stand or a picture frame, its speaker system will be provided without reducing the interior space of a room.

However, the vibration driver mounted on substantially the center of the acoustic vibrating plate may yet occupy a sizable space, and preventing any instrument using the panel speaker from being down-sized.

The panel speaker has a thickness which is a sum of the thickness of the acoustic vibrating plate and the thickness of the vibration driver. This will require the panel speaker having the foregoing structure to put unfavorably in a wider space.

Consider a case where a panel speaker is stored to address in the direction shown by the arrow 111, as shown in FIGS. 2A and 2B. An acoustic vibrating plate 1 could be seated in a space equal to the thickness 19 by the width 18 of the acoustic vibrating plate 1. However, in practice, a vibration driver 2 is mounted on substantially the center of the acoustic vibrating plate 1. Therefore, there is additionally required a space defined by the thickness 29 of the vibration driver 2 and a width 27 from the edge of the acoustic vibrating plate 1 to the edge of the vibration driver 2 on the back side. In this case, along the widthwise direction, a size defined by the width 27' from the edge of the acoustic vibrating plate 1 to the vibration driver 2 and the thickness 29 of the vibration driver 2 is a waste space.

Also, as shown in FIG. 3, if the two panel speakers are stored side by side, the thickness 209 required for the storage is equal to a sum of the thickness 109 of the panel speaker 100 composed of the acoustic vibrating plate 1 and the vibration driver 2 and the thickness 109' of a second panel speaker 100' composed of an acoustic vibrating plate 1' and a vibration driver 2'. More specifically, the overall thickness required for the storage is two times of a sum of the acoustic vibrating plate and the vibration driver, resulting in increase of the waste space.

FIG. 4 shows an attempt for reducing the overall thickness, in which the vibration drivers 2 and 2' of the panel speakers 100 and 100' are prevented from being overlapped each other. Although the overall thickness 209 is reduced by the thickness of one vibration driver as compared with the above panel speaker shown in FIG. 3. However, the overall height 110 is increased. This also fails to demonstrate the advantage of the thin-type panel speakers.

In a conventional speaker structure where the vibration driver is mounted at substantially the center of the acoustic vibrating plate, the acoustic vibrating plate is commonly made of an opaque material for shielding the vibration driver from view. Accordingly, the conventional panel speaker structure will be restrictive in the application and the down-sizing of any instrument using the conventional panel speaker will be difficult.

In conjunction with the above description, a panel type speaker is disclosed in Japanese Laid Open Patent Application (JP-A-Heisei 2-170795). In this reference, the panel type speaker is composed of a thin plate section and an electric-signal-to-vibration converter. A paint and photograph can be attached to a front plane of the thin plate section. A connection section is provided at a back plane to receive vibration. The converter is connected to the thin plate section to emit the vibration toward the thin plate section.

Also, a panel speaker is disclosed in Japanese Laid Open Patent Application (JP-A-Heisei 4-287500). In this reference, a concave portion (14) is formed in an acoustic vibration plate (1) in correspondence to an amplifier section (15). The amplifier section (15) is fit to the concave portion (14) and is fixed to a frame **(7*a*)**.

Also, a panel speaker with a waterproof function is disclosed in Japanese Patent No. 2,570,679. In this reference, a gap section is formed in resin sheet fitting section at the front and back planes of a resin frame panel in a panel speaker with a waterproof function. That is, resin sheets with a waterproof function are provided for the front and back planes of an acoustic vibration plat to which a piezoelectric type acoustic driver is provided for a foaming resin board. Limb sections of the resin sheets with the waterproof function are fit to the resin frame which is provided around the acoustic vibration plate. The section shape of the resin frame has a gap section such as U-shaped or Z-shaped formation.

SUMMARY OF THE INVENTION

Therefore, an object of the present invention is to provide a panel speaker in which the dimensions of a space for storing a panel speaker can be minimized.

Another object of the present invention is to provide a panel speaker in which the panel speaker itself or an instrument using the panel speaker can be down-sized by changing the location of a vibration driver on an acoustic vibrating plate.

Still another object of the present invention is to provide a panel speaker which has an acoustic vibrating plate made of a transparent material and can be used in wide application fields of a panel speaker.

In order to achieve an aspect of the present invention, a panel speaker includes an acoustic vibrating plate, and a vibration driver mounted off a center of the acoustic vibrating plate and applying vibration to the acoustic vibrating plate.

The vibration driver is desirably located outside of a region defined by connecting intermediate points of lines extending between the center of the acoustic vibrating plate and edges of the acoustic vibrating plate. In this case, the vibration driver is more desirably located at or adjacent to an edge portion of the acoustic vibrating plate. The acoustic vibrating plate may be formed to have substantially a rectangular shape, and the vibration driver is located at or adjacent to a corner of the acoustic vibrating plate.

The direction of application of the vibration by the vibration driver desirably may be a direction other than a direction perpendicular to a surface plane of the acoustic vibrating plate.

Also, the acoustic vibrating plate desirably has a transparent material film provided at least locally thereon to allow a background to be viewed. In addition, the acoustic vibrating plate may have a reflection preventing film provided at least locally thereon to prevent reflection of incoming light, or a light reflective film to reflect incoming light.

In order to achieve another aspect of the present invention, a panel speaker includes an acoustic vibrating plate, and a plurality of vibration drivers mounted outside of a region defined by connecting intermediate points of lines extending between a center of the acoustic vibrating plate and edges of the acoustic vibrating plate, and applying vibration on the acoustic vibrating plate.

Here, at least one of the plurality of vibration drivers is desirably located at or adjacent to an edge portion of the acoustic vibrating plate. When the acoustic vibrating plate is formed to have substantially a rectangular shape, the vibration driver may be located at or adjacent to one corner of the acoustic vibrating plate.

The direction of application of the vibration by the vibration driver may be a direction other than a direction perpendicular to a surface plane of the acoustic vibrating plate.

Also, an amplitude of the vibration applied by at least one of the plurality of vibration drivers may be different from an amplitude of the vibration applied by each of the remaining vibration drivers. The direction of the vibration applied by at least one of the plurality of vibration drivers may be different from a direction of the vibration applied by each of the remaining vibration drivers. In addition, the phase of the vibration applied by at least one of the plurality of vibration drivers may be different from a phase of the vibration applied by each of the remaining vibration drivers.

Also, the acoustic vibrating plate may have a transparent material film provided at least locally thereon to allow a background to be viewed, or have a reflection preventing film provided at least locally thereon to prevent reflection of incoming light, or a light reflective film to reflect incoming light.

In order to achieve still another aspect of the present invention, a panel speaker includes an acoustic vibrating plate, a plurality of vibration drivers mounted outside of a region defined by connecting intermediate points of lines extending between a center of the acoustic vibrating plate and edges of the acoustic vibrating plate and applying vibration on the acoustic vibrating plate, and a control unit controlling at lease one of the plurality of vibration drivers.

The control unit controls an amplitude of the vibration applied by the at least one vibration driver, or controls a phase of the vibration applied by the at least one vibration driver. Also, the control unit controls the plurality of vibration drivers to control propagation of vibration in the acoustic vibrating plate.

Also, the acoustic vibrating plate may have a transparent material film provided at least locally thereon to allow a background to be viewed, or have a reflection preventing film provided at least locally thereon to prevent reflection of incoming light, or a light reflective film to reflect incoming light.

DESCRIPTION OF THE PREFERRED EMBODIMENTS

Hereinafter, a panel speaker of the present invention will be described below in detail with reference to the attached drawings.

Figure 7:
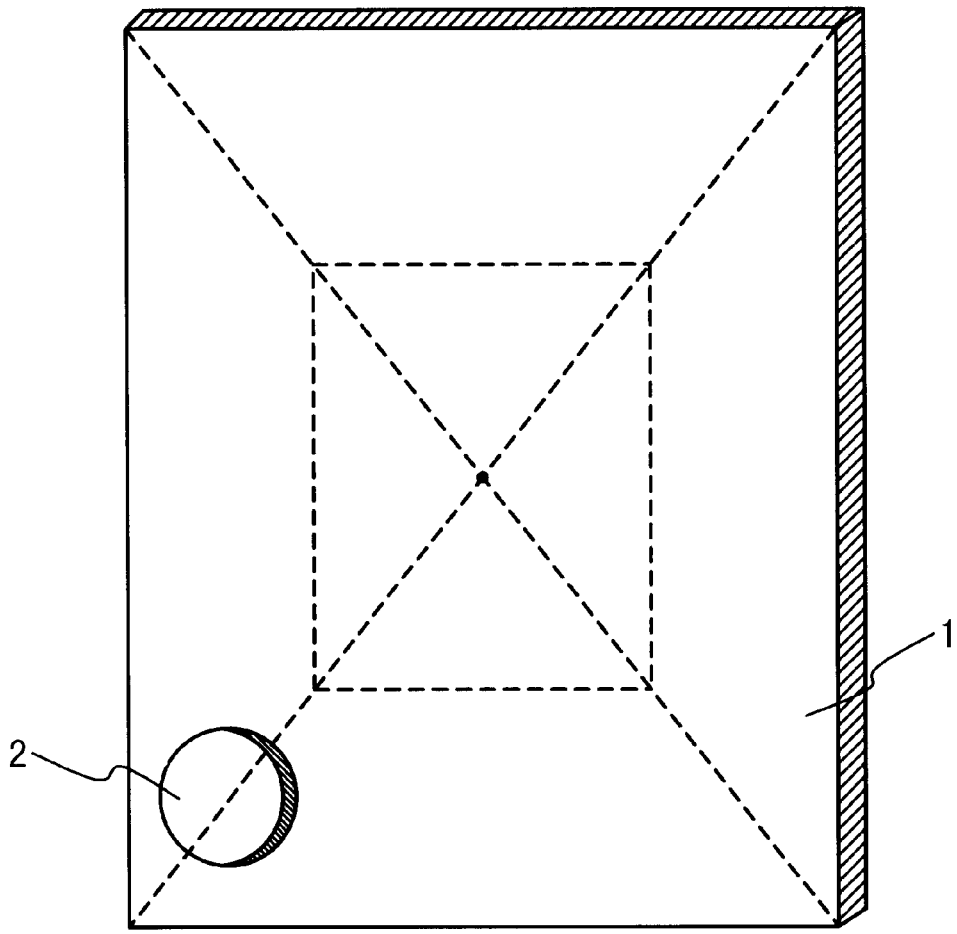
FIG. 7 is a schematic view of a panel speaker according to a first embodiment of the present invention.

FIG. 7 is a schematic view of the panel speaker according to the first embodiment of the present invention. As shown in FIG. 7, the panel speaker is composed of an acoustic vibrating plate 1 and a vibration driver 2. The vibration driver 2 in this embodiment is located off the center of the acoustic vibrating plate 1.

Figure 1:
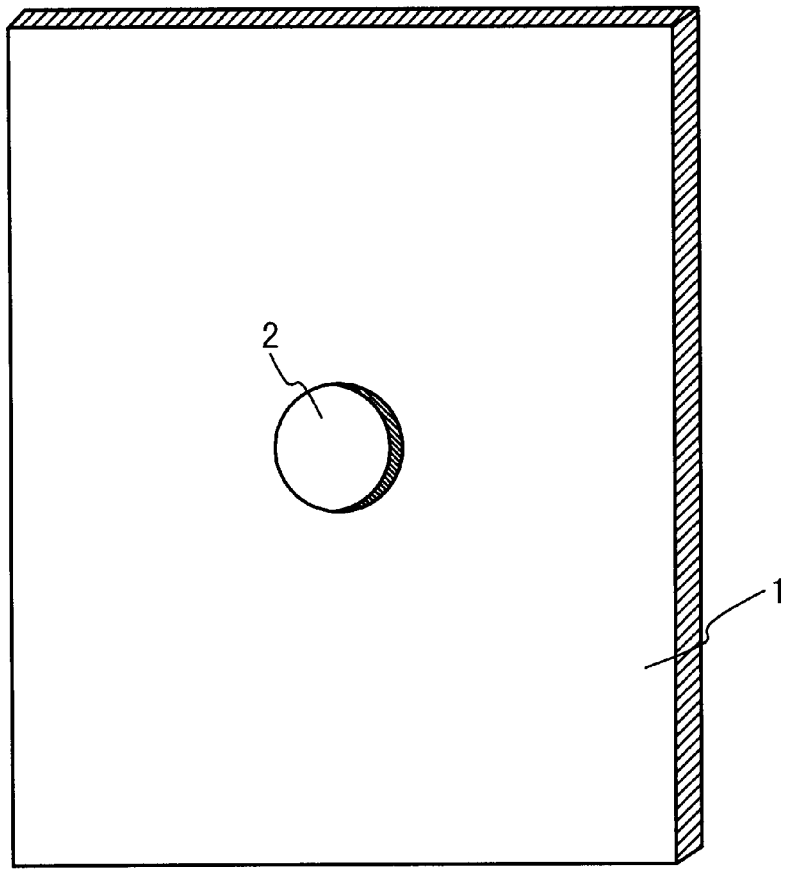
Fig. 1 PRIOR ART
FIG. 1 a schematic view showing an structure of a conventional panel speaker.
Figure 2A:
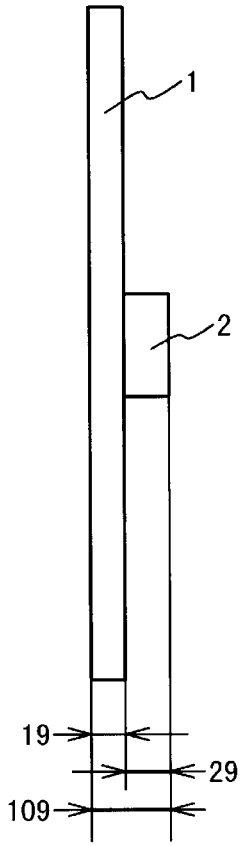
Fig. 2A PRIOR ART
FIGS. 2A and 2B are schematic views describing a concept of the thickness of the conventional panel speaker.
Figure 2B:
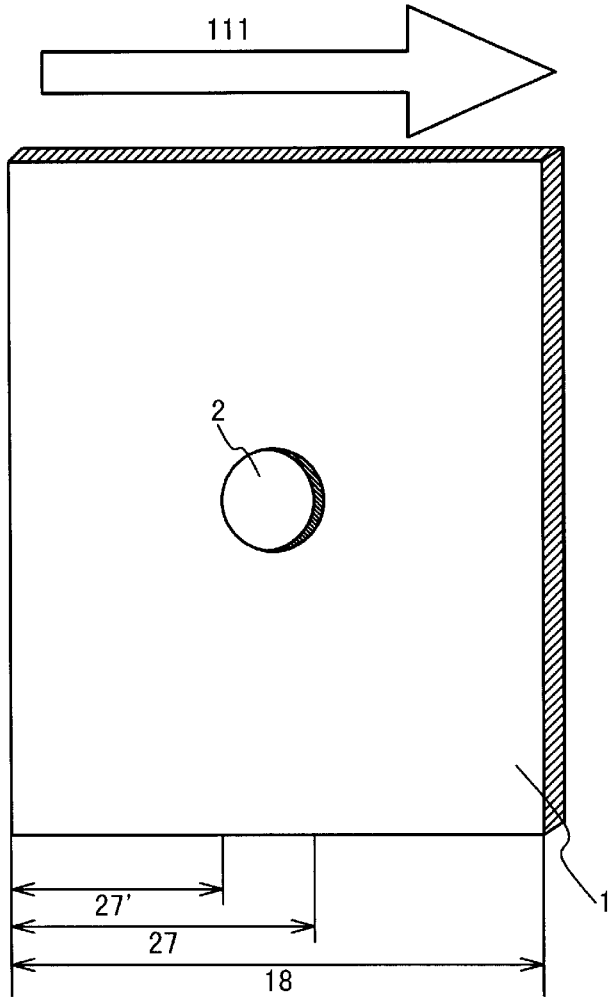
Fig. 2B PRIOR ART
Figure 3:
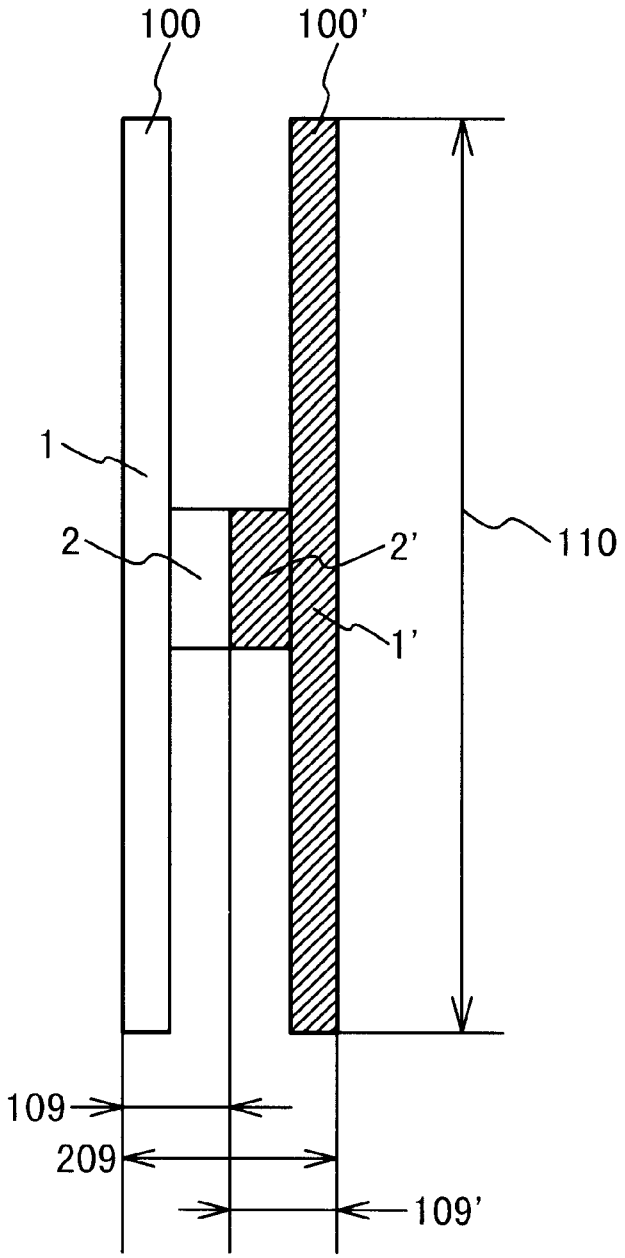
Fig. 3 PRIOR ART
FIG. 3 is a schematic view describing two of the conventional panel speakers arranged side by side.
Figure 4:
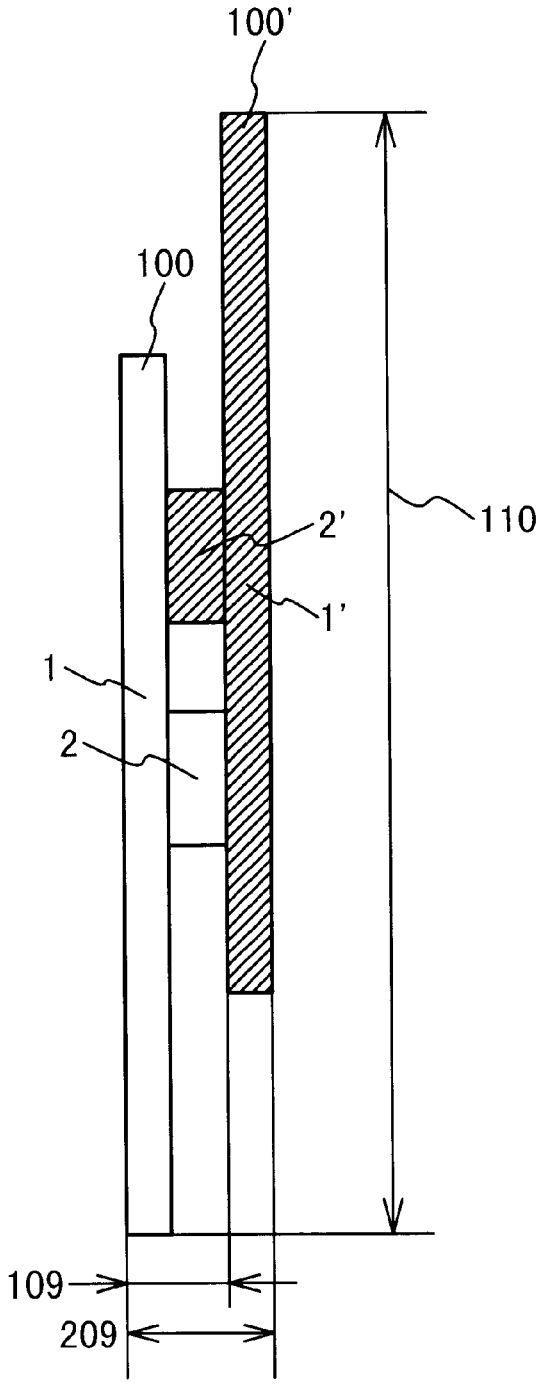
Fig. 4 PRIOR ART
FIG. 4 is a schematic view describing two of the conventional panel speakers arranged side by side in another relationship.
Figure 8A:
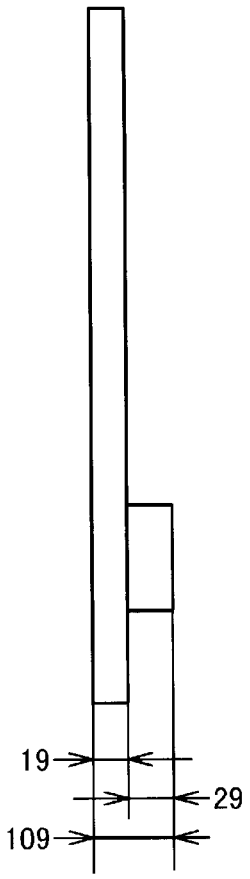
FIGS. 8A and 8B are schematic views describing a concept of the thickness of the panel speaker shown in FIG. 7.
Figure 8B:
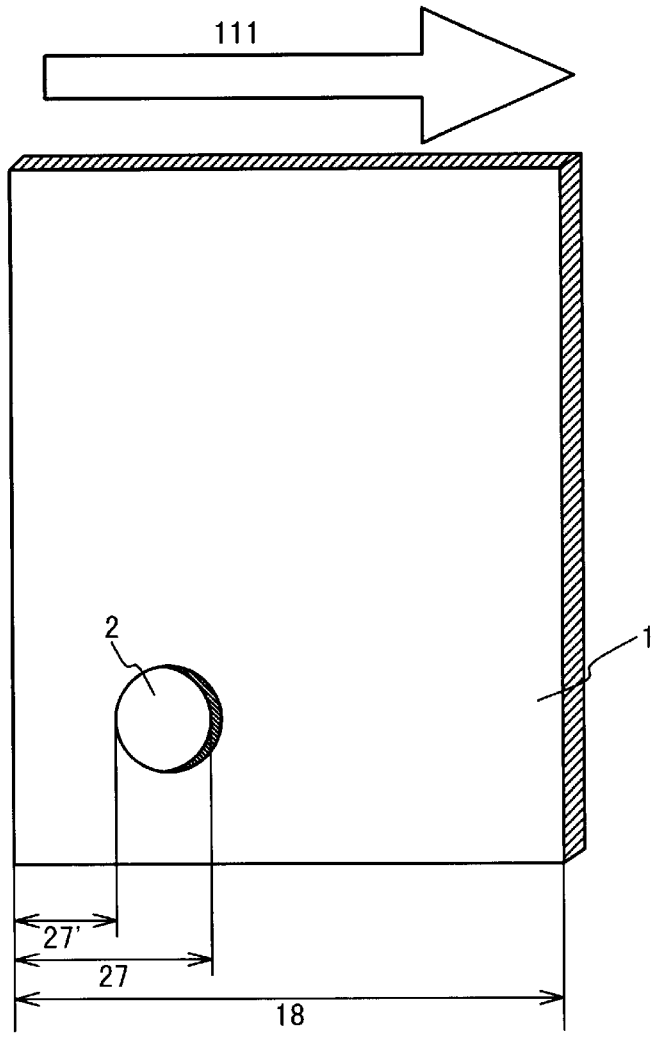

FIGS. 8A and 8B are schematic views showing the space required for storing the panel speaker of FIG. 7 addressing in the direction shown by the arrow 111. As described above, in the conventional speaker structure shown in FIG. 1, the vibration driver 2 is mounted adjacent to the center of the acoustic vibrating plate. As compared with the conventional panel speaker, the width 27 from an edge of the acoustic vibrating plate 1 to an edge of the vibration driver 2 on the back side in the arrow direction is decreased. As a result, the space for storage can be reduced.

Also, as shown in FIG. 7, the vibration driver 2 is located outside of a region formed by connecting the intermediate points of lines between the center and the corners of the acoustic vibrating plate 1. In this case, therefore, the space for storage can be reduced, since the acoustic vibrating plate 1 has advantageously a wider free-space zone about the center thereof. Therefore, the wider zone can contribute to the down-sizing of an panel speaker itself and a panel speaker system using the panel speaker. Also, the wider zone allows the acoustic vibrating plate 1 to be utilized for a more number of applications.

Figure 9:
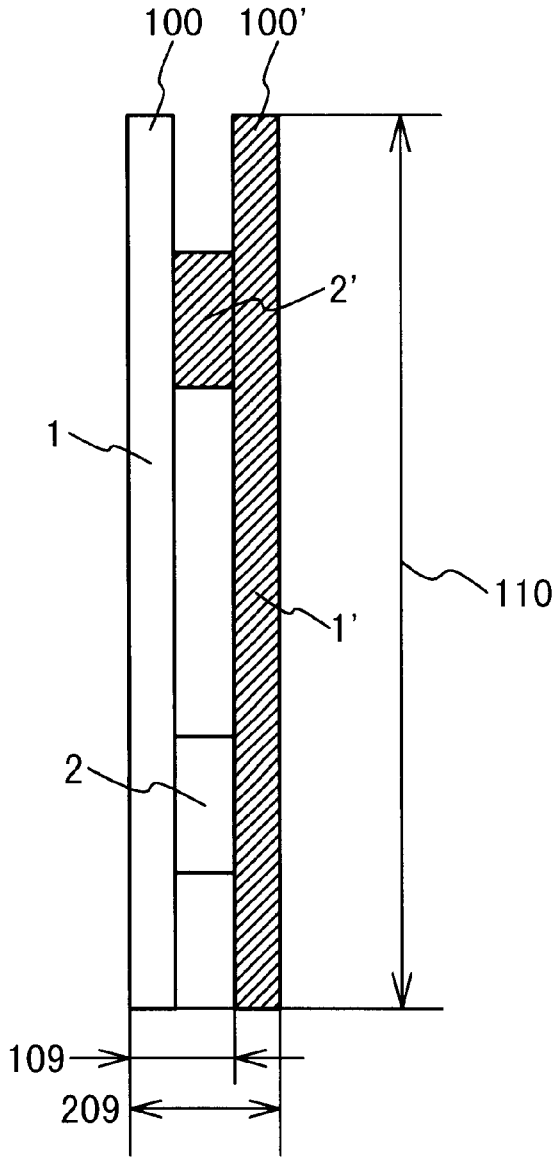
FIG. 9 is a schematic view describing two of the panel speakers in the first embodiment shown in FIG. 7 arranged side by side in another relationship.

Also, in case where a first panel speaker 100 is composed of an acoustic vibrating plate 1 and a vibration driver 2, and a second panel speaker 100' is composed of an acoustic vibrating plate 1' and a vibration driver 2', it is supposed that two of the panel speakers are placed side by side as shown in FIG. 9. In this case, the vibration driver 2 of the first panel speaker 100 is different in location from the vibration driver 2' of the second panel speaker 100'. Accordingly, while the two are set side by side, their height 110 remains unchanged. The thickness at that time is equal to a sum of two times the thickness of the acoustic vibrating plate 1 and 1' and the thickness of the vibration driver 2. Thus, the panel speaker can be downsized and its storage requirement will be improved.

Figure 10:
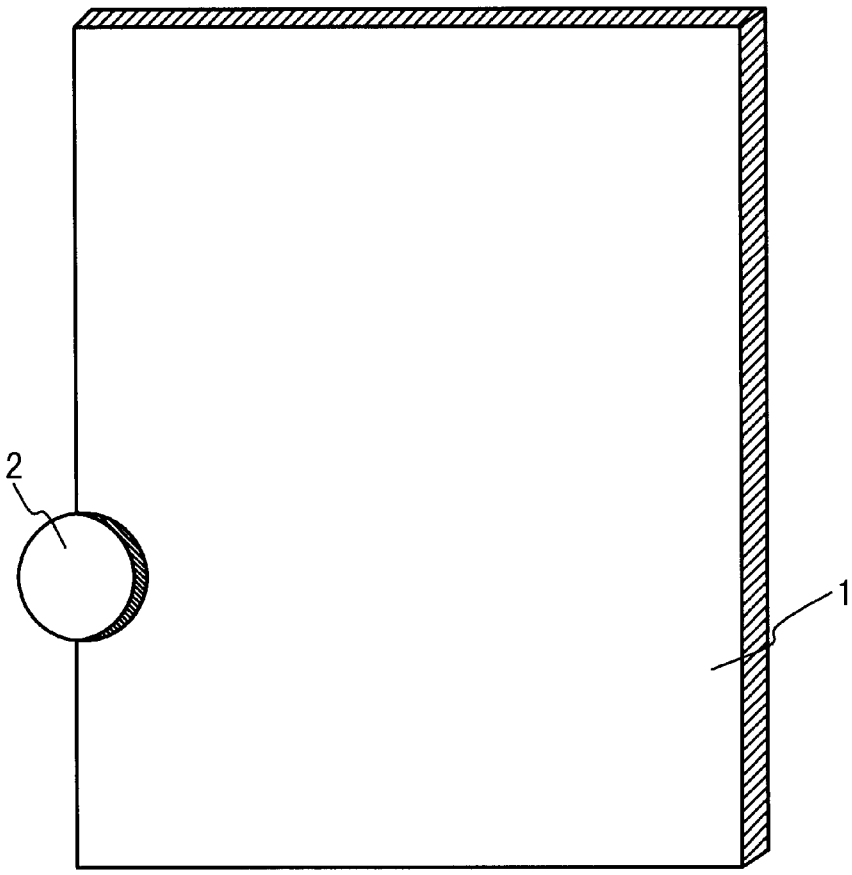
FIG. 10 is a schematic view of a panel speaker according to a second embodiment of the present invention.

FIG. 10 is a schematic view of the panel speaker according to the second embodiment of the present invention. As shown in FIG. 10, the panel speaker in the second embodiment is composed of the acoustic vibrating plate 1 and the vibration driver 2. The vibration driver 2 in this embodiment is located at an edge portion of the acoustic vibrating plate 1. In this way, the width 27 from an edge of the acoustic vibrating plate 1 to an edge of the vibration driver 2 on the back side in the storage direction can be much reduced, compared with the panel speaker in the first embodiment. Hence, the space required for storage can be further reduced. Also, in case that the panel speaker in the second embodiment is utilized as a picture frame speaker, the vibration driver 2 can be mounted in the picture frame. This allows the thickness of the picture frame speaker to be reduced, maintaining the broadness of a living space.

Figure 11:
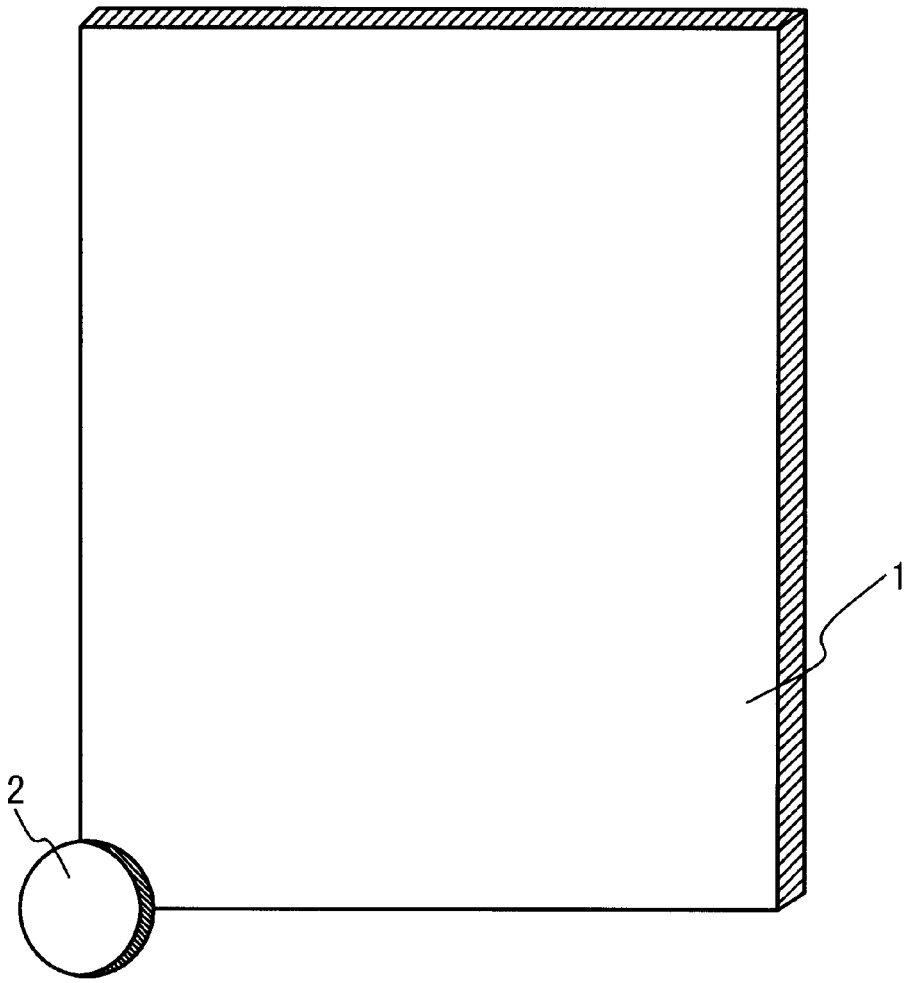
FIG. 11 is a schematic view of a panel speaker according to a third embodiment of the present invention.

FIG. 11 is a schematic view of the panel speaker according to the third embodiment of the present invention. As shown in FIG. 11, the panel speaker is composed of the acoustic vibrating plates and the vibration driver 2. The vibration driver 2 in the third embodiment is located at one corner of the acoustic vibrating plate 1. In this way, the width 27 from an edge of the acoustic vibrating plate 1 to an edge of the vibration driver 2 on the back side in the storage direction can be further minimized, compared with the case in the first embodiment. Hence, the space required for storage can be further reduced. Also, in case that the panel speaker in the third embodiment is utilized as a picture frame speaker, the vibration driver 2 can be mounted in the picture frame. This allows the thickness of the picture frame speaker to be reduced, maintaining the broadness of a living space.

Figure 14:
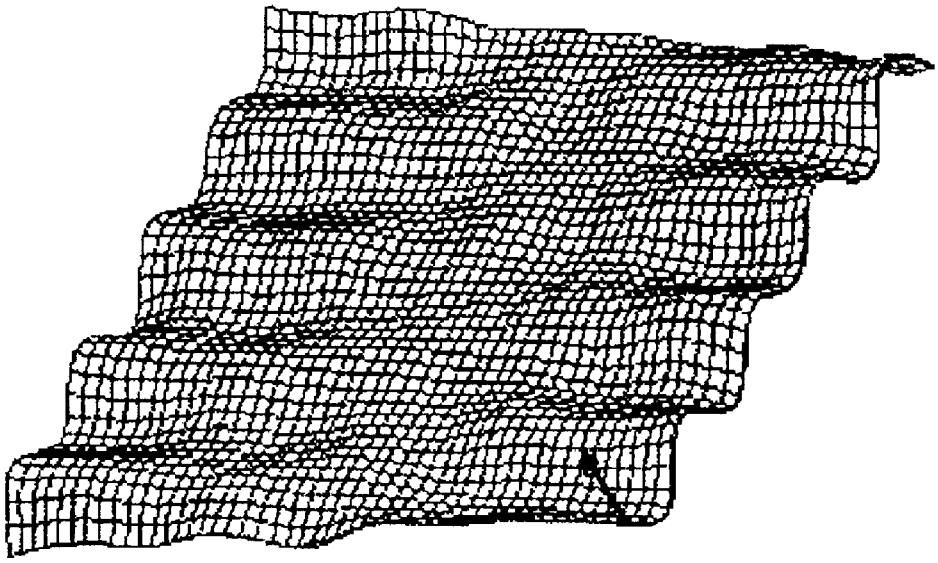
FIG. 14 is a profile of vibration of the acoustic vibrating plate when the vibration of 5 kHz is applied to the panel speaker shown in FIG. 11.
Figure 15:
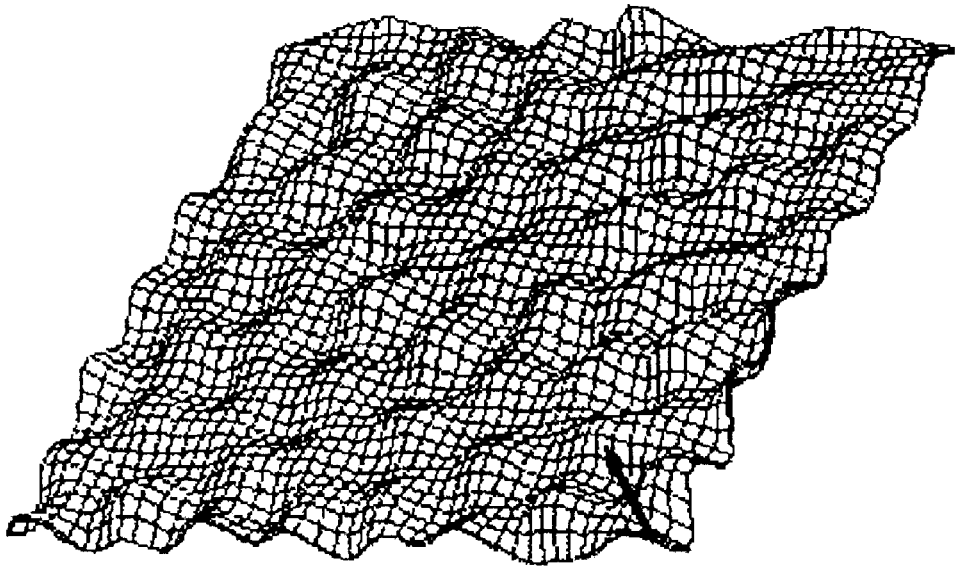
FIG. 15 is a profile of vibration of the acoustic vibrating plate when the vibration of 15 kHz is applied to the panel speaker shown in FIG. 11.

FIGS. 14 and 15 illustrate profiles of simulation of the acoustic vibrating plate 1 of the panel speaker according to the third embodiment of the present invention shown in FIG. 11 when vibrations having the frequencies of 5 kHz and 15 kHz are applied to its corner of the acoustic vibrating plate 1, respectively. In the figures, the arrow marks indicate the direction of application of the vibrations, and the amplitudes of vibrations of the acoustic vibrating plate 1 are exaggerated.

Figure 5:
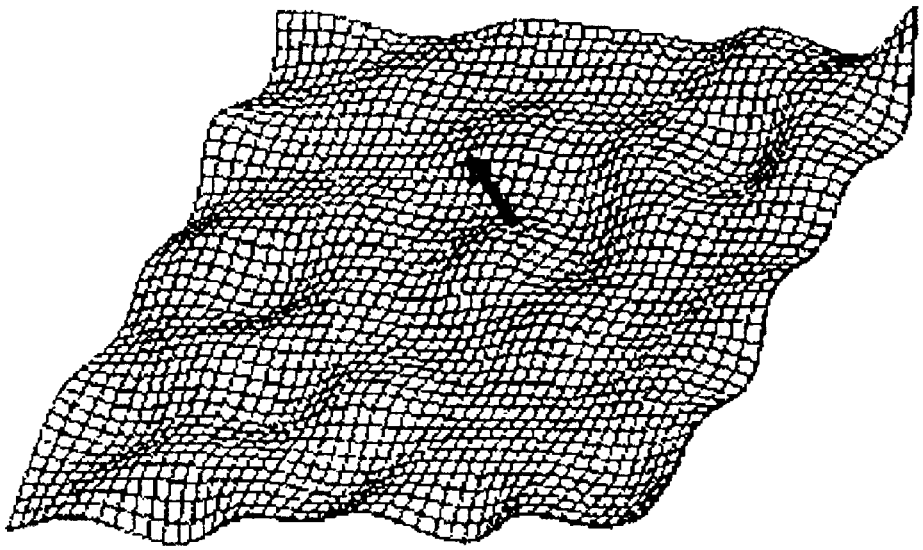
Fig. 5 PRIOR ART
FIG. 5 is a profile of vibration on the acoustic vibrating plate when the vibration of 5 kHz is applied to the acoustic vibrating plate in the conventional panel speaker shown in FIG. 1.
Figure 6:
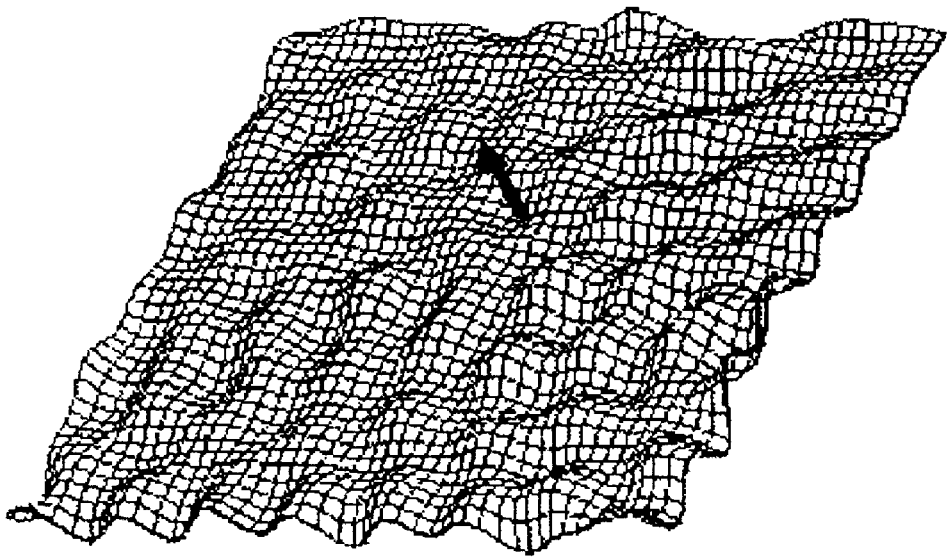
Fig. 6 PRIOR ART
FIG. 6 is a profile of vibration on the acoustic vibrating plate when the vibration of 15 kHz is applied to the acoustic vibrating plate in the conventional panel speaker shown in FIG. 1.

In comparison between the vibration of the acoustic vibrating plate 1 in the third embodiment and the vibration in the conventional panel speaker shown in FIGS. 5 or 6, the both are similar at 15 kHz but very different at 5 kHz. More specifically, sounds produced by the vibration of the acoustic vibrating plate 1 in the third embodiment may be different more or less from those produced by vibration applied to the center of the conventional panel, depending on the applied frequency.

Figure 12:
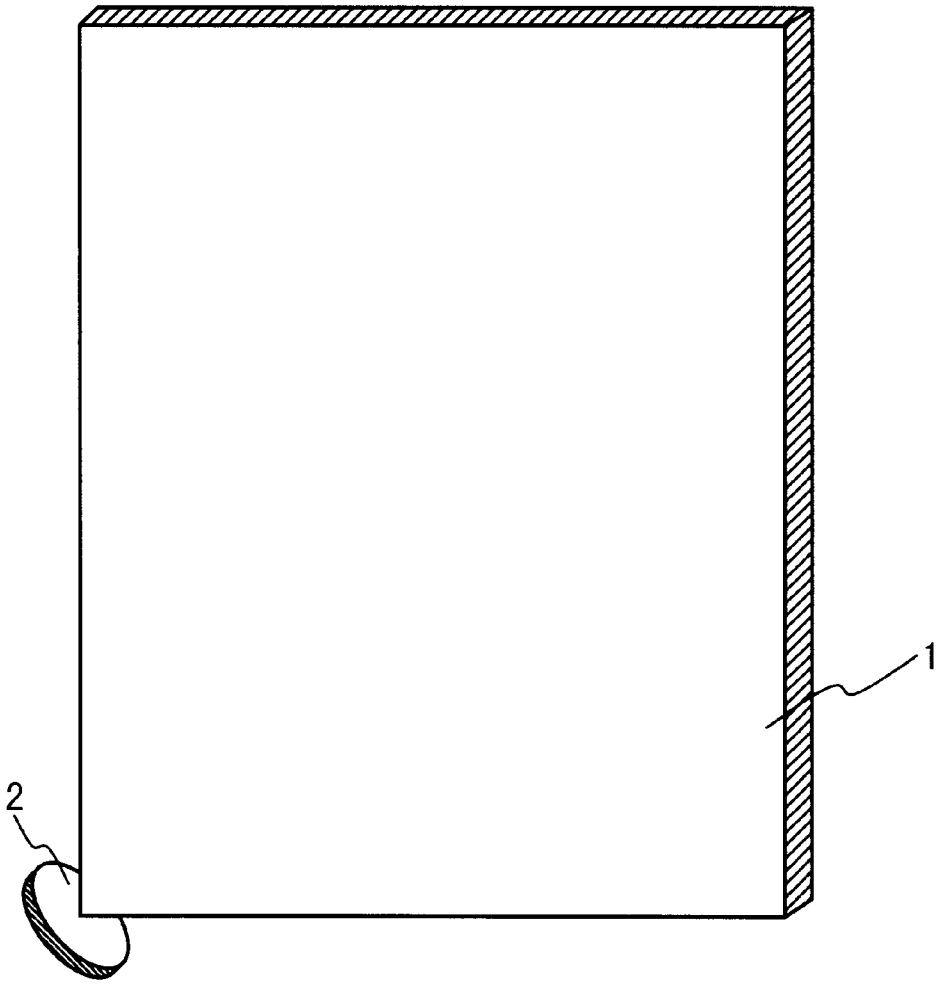
FIG. 12 is a schematic view of a panel speaker according to a fourth embodiment of the present invention.

FIG. 12 is a schematic view of a panel speaker according to the fourth embodiment of the present invention. As shown in FIG. 12, the panel speaker is composed of the acoustic vibrating plate 1 and the vibration driver 2. The vibration driver 2 in the fourth embodiment is located at one corner of the acoustic vibrating plate 1 to apply vibration to the acoustic vibrating plate 1 into a direction different from the direction perpendicular to the surface plane of the acoustic vibrating plate 1.

Figure 13A:
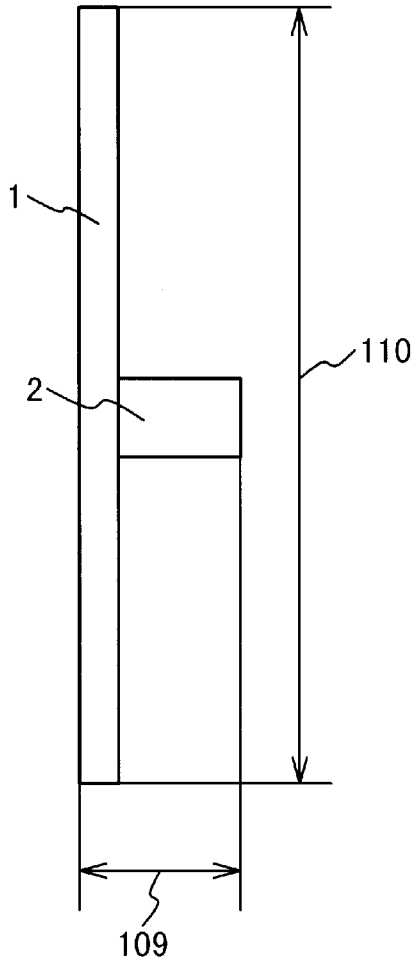
FIGS. 13A and 13B are schematic views describing a concept of the thickness of the conventional panel speaker and a concept of the thickness of the panel speaker shown in FIG. 12.
Figure 13B:
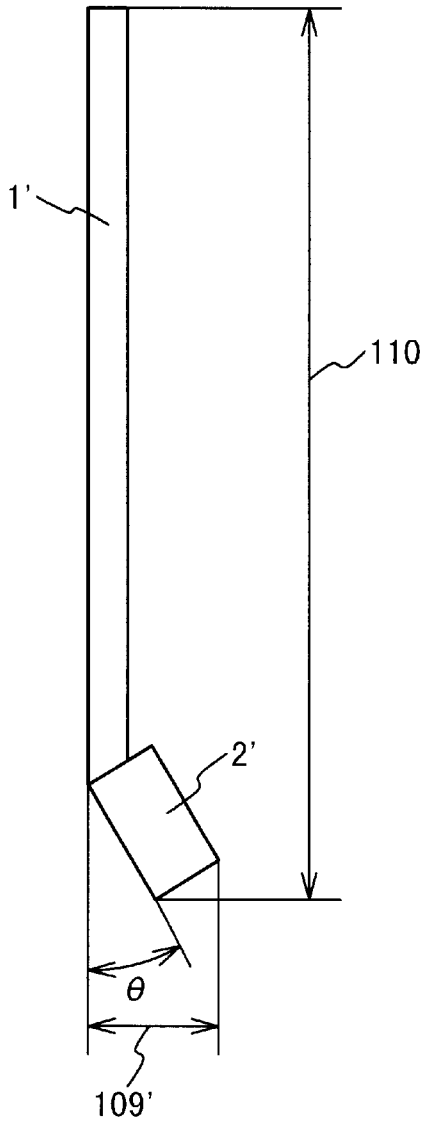

FIG. 13A illustrates a case that the vibration driver 2 extends in the direction perpendicular to the surface plane of the acoustic vibrating plate 1. FIG. 13B illustrates a case that the vibration driver 2' is arranged to have an angle $\theta$ ($0 \leqq \theta < 90$ degrees) to the surface plane the acoustic vibrating plate 1'. The provision of the angle $\theta$ decreases the overall thickness of the panel speaker shown in FIG. 13B to the thickness 109' smaller than the overall thickness 109 of the panel speaker shown in FIG. 13A. As the angle $\theta$ becomes close to zero, the effect can be expected to be large. Accordingly, the panel speaker can be down-sized and its storage requirement will be improved.

Figure 16:
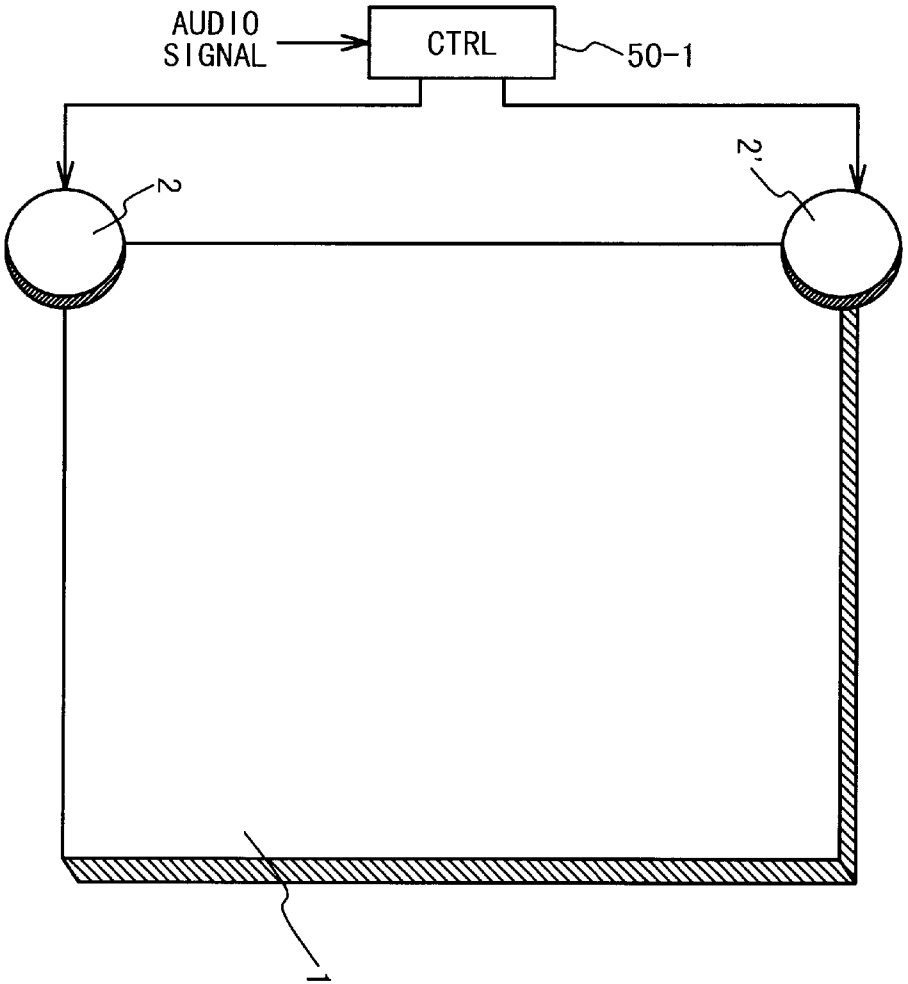
FIG. 16 is a schematic view of a panel speaker according to a fifth embodiment of the present invention.

FIG. 16 is a schematic view of a panel speaker according to the fifth embodiment of the present invention. The panel speaker in the fifth embodiment is composed of the acoustic vibrating plate 1, a first vibration driver 2, an additional, second vibration driver 2', and a control unit 50-1. The first vibration driver 2 is mounted at one corner of the acoustic vibrating plate 1 and the second vibration driver 2' is mounted to another corner of the acoustic vibrating plate for producing a vibration close to the vibration of the conventional panel speaker. The control unit 50-1 receives an audio signal to drive the first and second vibration drivers 2 and 2'.

Figure 17:
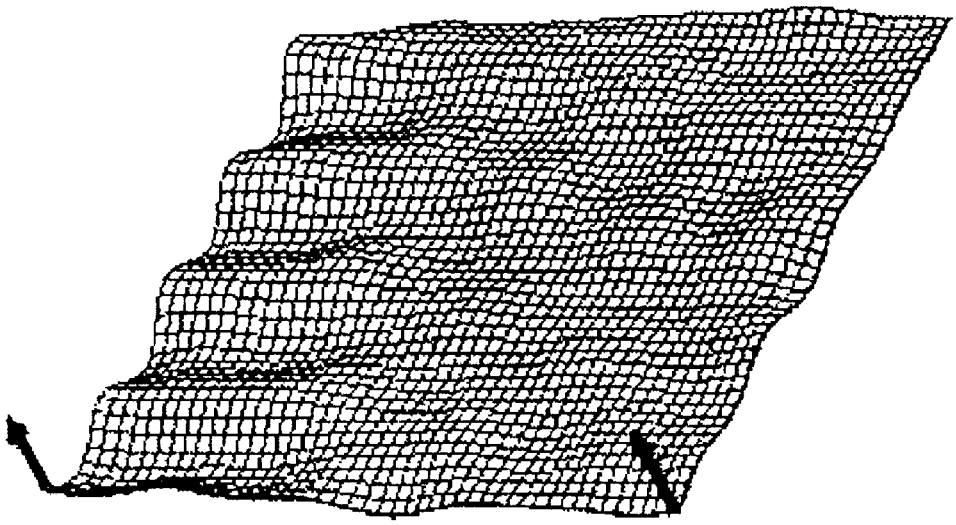
FIG. 17 is a profile of vibration of the acoustic vibrating plate when the vibration of 5 kHz is applied to the panel speaker shown in FIG. 16.
Figure 18:
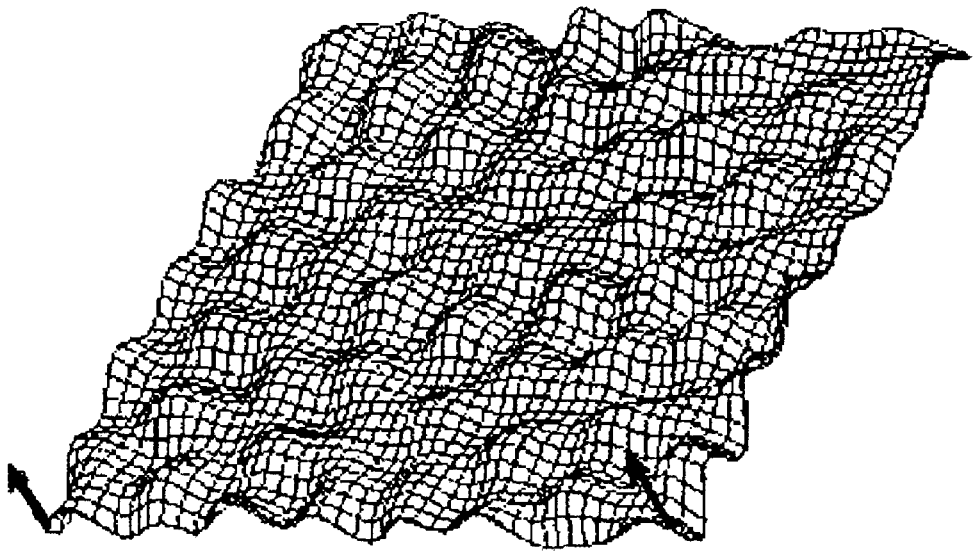
FIG. 18 is a profile of vibration of the acoustic vibrating plate when the vibration of 15 kHz is applied to the panel speaker shown in FIG. 16.

FIGS. 17 and 18 illustrate profiles of simulation of the acoustic vibrating plate 1 in the fifth embodiment when vibrations having the frequencies of 5 kHz and 15 kHz are applied to the vibration drivers 2 and 2' at two different corners. In the figures, the arrow marks indicate the direction of vibration, and the amplitudes of vibrations of the acoustic vibrating plate 1 are exaggerated. In this case, the vibration of the acoustic vibrating plate 1 at the frequency of 5 kHz in the fifth embodiment is similar to that of the conventional panel speaker shown in FIG. 5, although locally. On the other hand, the vibration of the acoustic vibrating plate 1 at the frequency of 15 kHz in the fifth embodiment is similar to that of the conventional panel speaker shown in FIG. 6, as in that of the third embodiment. This embodiment allows the difference of vibration of the acoustic vibrating plate 1 at 5 kHz between the third embodiment and the conventional panel speaker to be reduced while the similarity of the vibration at 15 kHz of the third embodiment to that of the conventional one remains. Accordingly, sounds produced in the fifth embodiment can be improved compared with that of the third embodiment.

Figure 19:
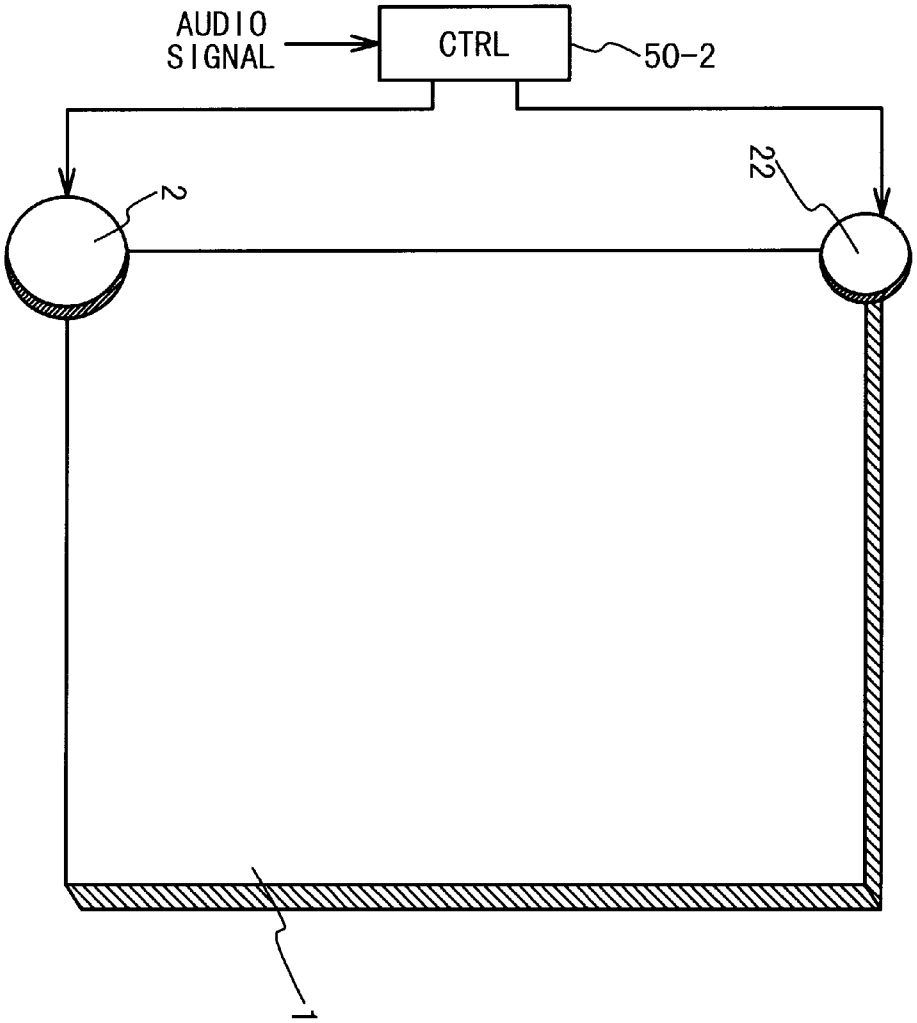
FIG. 19 is a schematic view of a panel speaker according to a sixth embodiment of the present invention.

FIG. 19 is a schematic view of a panel speaker according to the sixth embodiment of the present invention. The panel speaker in the sixth embodiment is composed of the acoustic vibrating plate 1, a first vibration driver 2, an additional, second vibration driver 22, and a control unit 50-2. In this embodiment, the second vibration driver 22 is smaller in size than the first vibration driver 2, and is provided at a different corner of the acoustic vibrating plate 1 from the corner where the first vibration driver 2 is provided. The control unit 50-2 controls the second vibration driver 22 to drive the acoustic vibrating plate 1 with the vibration having an amplitude smaller than that of the vibration which is applied to the first vibration driver 2. Thus, the control unit 50-2 controls propagation of vibration in the acoustic vibrating plate. That is, by applying the vibrations of different amplitudes to the different vibration drivers 2 and 22, a vector of the applied vibrations can be changed or controlled.

Figure 20:
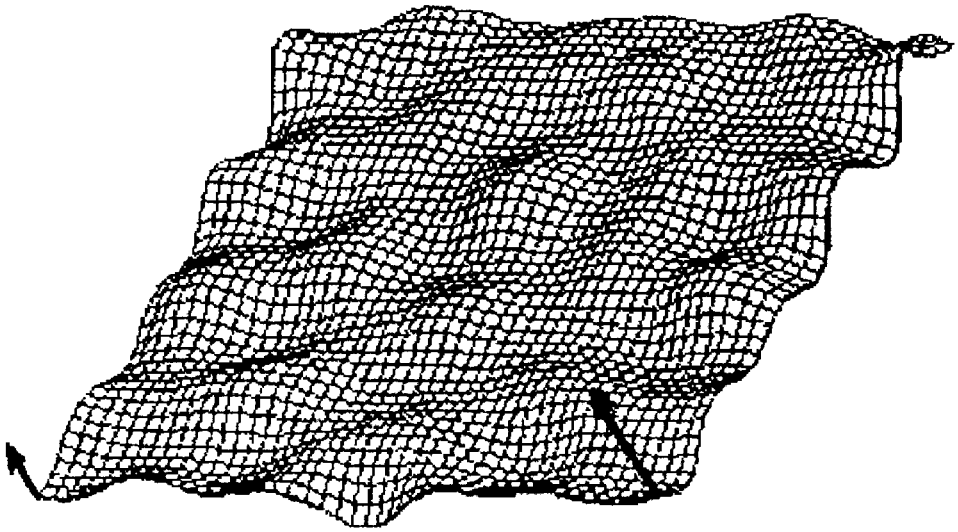
FIG. 20 is a profile of vibration of the acoustic vibrating plate when the vibration of 5 kHz is applied to the panel speaker shown in FIG. 19.
Figure 21:
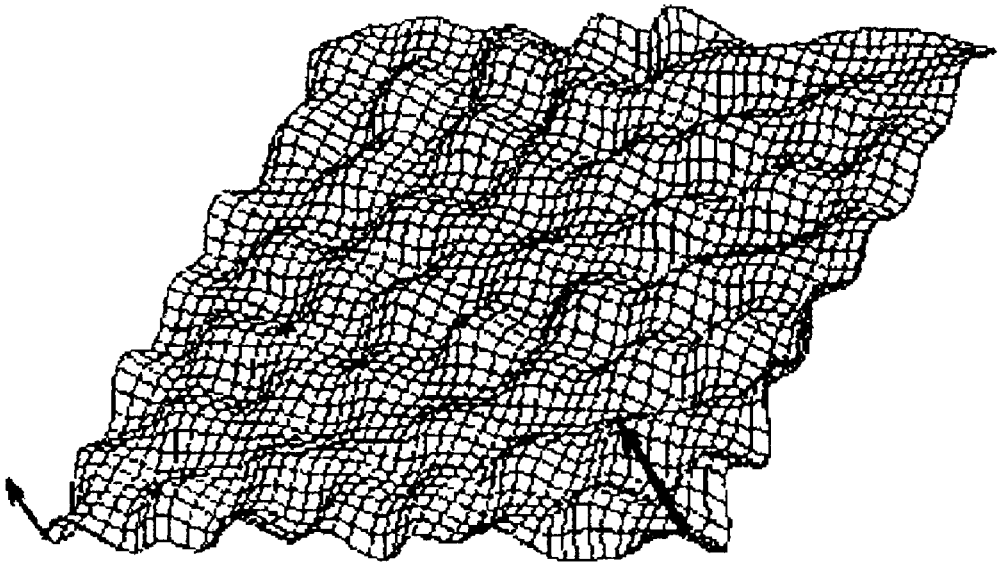
FIG. 21 is a profile of vibration of the acoustic vibrating plate when the vibration of 15 kHz is applied to the panel speaker shown in FIG. 19.

FIGS. 20 and 21 illustrate profiles of simulation of the acoustic vibrating plate 1 in the sixth embodiment to which vibrations having the frequencies of 5 kHz and 15 kHz are applied to the two different corners of the acoustic vibrating plate 1, respectively. In the figures, the arrow marks indicate the directions of application of vibrations, and the amplitudes of vibrations of the acoustic vibrating plate 1 are exaggerated. As apparent from the simulation profiles, the vibration of the acoustic vibrating plate 1 at the frequency of 5 kHz is much similar to that that of the conventional panel speaker shown in FIG. 5, as compared with that of the fifth embodiment. Also, the vibration of the acoustic vibrating plate 1 at the frequency of 15 kHz is similar to that of the conventional one, as in the fifth embodiment.

According to the sixth embodiment, the difference of vibration at the frequency of 5 kHz between the fifth embodiment and the conventional panel speaker is reduced. On the other hand, the similarity of the vibration at the frequency of 15 kHz of the third or fifth embodiment to that of the conventional one remains. Accordingly, sounds produced in the sixth embodiment can be improved, compared with the effect of the fifth embodiment. Therefore, as understood from the above, the control unit 50-2 may selects frequency ranges based on the sizes and/or positions of vibration drivers. Then, the control unit 50-2 controls the vibration driver 2 to apply vibration at a frequency range including 15 kHz to the acoustic vibrating plate 1 and the vibration drivers 2 and 22 to apply vibration at another frequency range including 5 kHz to the acoustic vibrating plate 1. In this way, energy consumption will further be reduced while the level of reproduced sounds remains unchanged.

Figure 22:
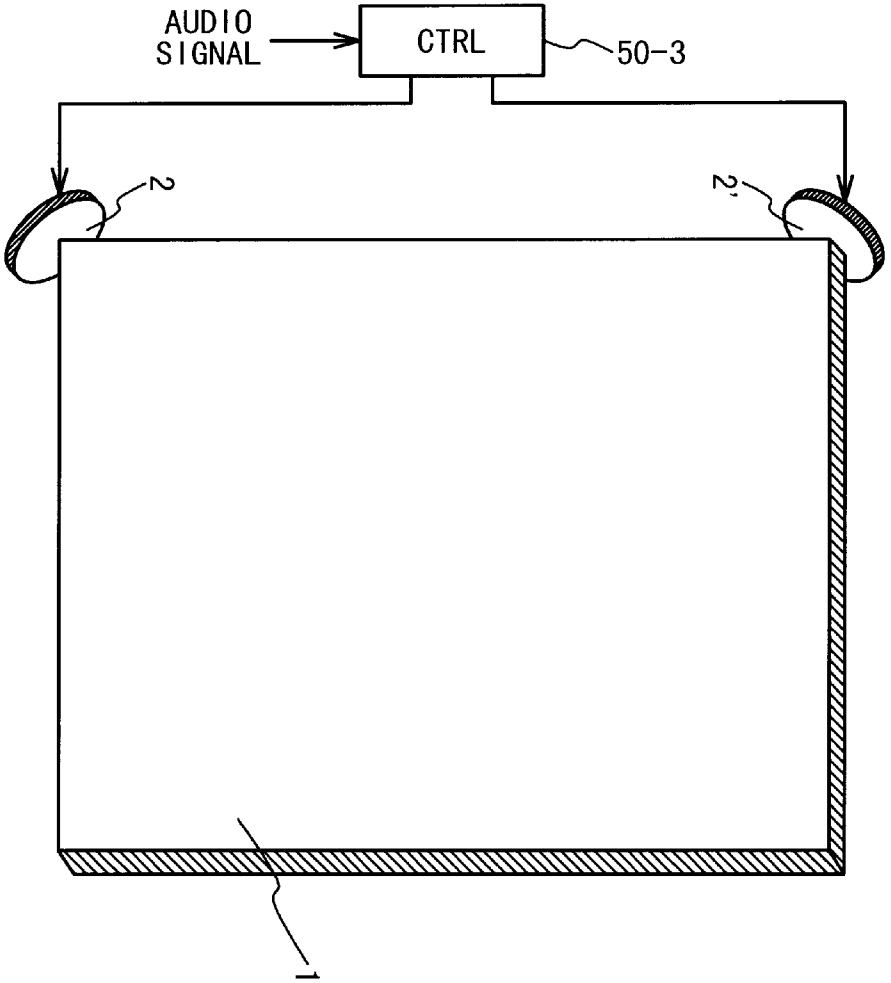
FIG. 22 is a schematic view of a panel speaker according to a seventh embodiment of the present invention.

FIG. 22 is a schematic view of a panel speaker according to the seventh embodiment of the present invention. The panel speaker in the seventh embodiment is composed of the acoustic vibrating plate 1, a first vibration driver 2, a second vibration driver 2', and a control unit 50-3. The second vibration driver 2' is applied with vibration to have a direction different from vibration applied to the vibration driver 2. At that time, the second vibration driver 2' may be also applied with vibration to have a different amplitude from vibration applied to the vibration driver 2. In this embodiment, the vibration driver 2 and the second vibration driver 2' are mounted on two different corners of the acoustic vibrating plate 1 such that their directions of application of vibration are different from each other. This provides the same effect as of the fifth and sixth embodiments for improving the quality of reproduced sounds.

Figure 23:
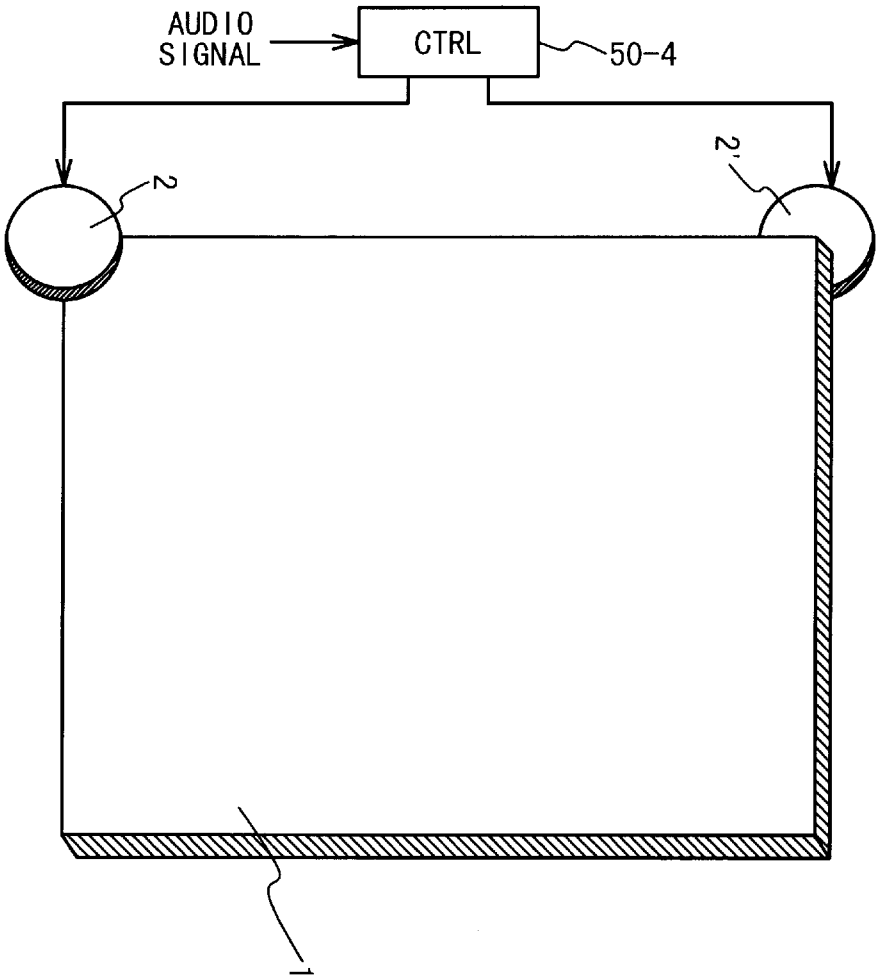
FIG. 23 is a schematic view of a panel speaker according to an eighth embodiment of the present invention.

FIG. 23 is a schematic view of a panel speaker according to the eighth embodiment of the present invention. The panel speaker in the eighth embodiment is composed of the acoustic vibrating plate 1, a first vibration driver 2, an additional, second vibration driver 2', and a control unit 50-4. The second vibration driver 2' applies vibration to the acoustic vibrating plate 1 from a direction opposite to that of the vibration driver 2. The eighth embodiment is to meet a requirement where the two vibration drivers 2 and 2' are mounted on both of the front surface side and the back surface side of the acoustic vibrating plate 1. The control unit 50-4 controls the first and second vibration drivers 2 and 2' based on their positions such that the phase of the vibration applied to the second vibration driver 2' is inverse to that of the vibration applied to the vibration driver 2. In this case, the same effect as of the fifth and sixth embodiments can be obtained.

Figure 24:
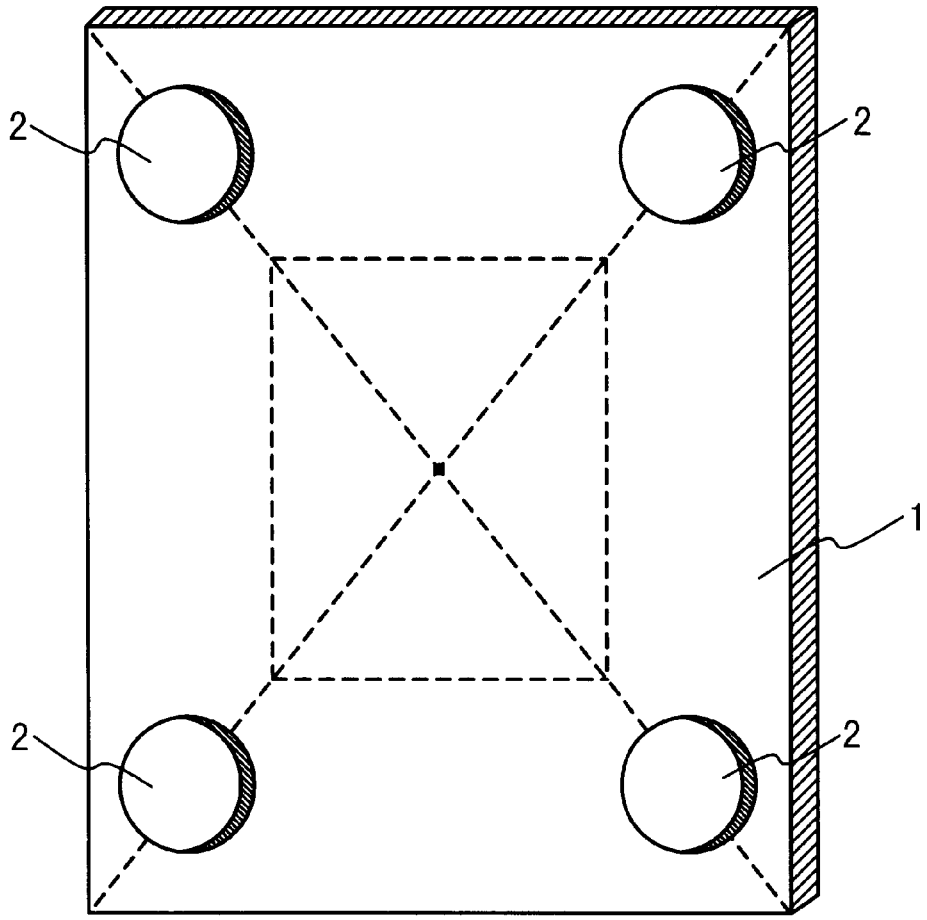
FIG. 24 is a schematic view of a panel speaker according to a ninth embodiment of the present invention.

It should be noted that the number of the vibration drivers used in each previous embodiment is not limited to one or two but may be three or more if desired. FIG. 24 shows a ninth embodiment of the present invention in which more than three of the vibration drivers 2 are mounted on the acoustic vibrating plate 1. In that case, the vibration drivers 2 are positioned outside of a region formed by connecting the intermediate points of lines between the center of the acoustic vibrating plate 1 and the edges of the acoustic vibrating plate 1, respectively. This saves a wider space at the center of the acoustic vibrating plate 1 which may be used for other purposes.

Figure 25:
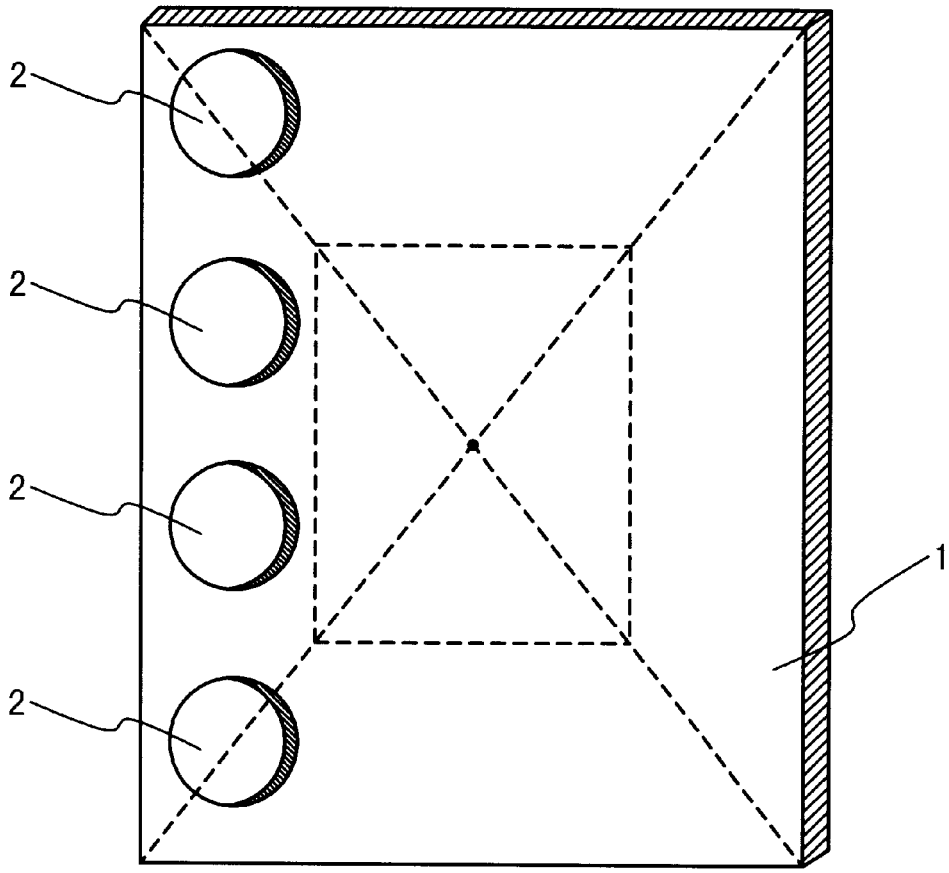
FIG. 25 is a schematic view of a panel speaker according to a tenth embodiment of the present invention.

FIG. 25 illustrates the panel speaker according to the tenth embodiment of the present invention where more than three of the vibration drivers 2 are used. In this embodiment, all the vibration drivers 2 are located outside of a region formed by connecting the intermediate points of the lines between the center of the acoustic vibrating plate 1 and the edges of the acoustic vibrating plate 1. Also, the all the vibration drivers 2 are located nearly to one side of the acoustic vibrating plate 1. In the tenth embodiment, the volume of the panel speaker necessary for storage can further be reduced in addition to the effect of the ninth embodiment.

As described previously, the location of application of vibration by the vibration driver is off the center of the acoustic vibrating plate. Thus, the acoustic vibrating plate can vibrate to have a different pattern of vibration from any of the conventional panel speakers, depending on a combination of the location and direction of application of the vibration and the frequency and amplitude of the vibration.

In the above fifth to tenth embodiments, the control unit may control at least one of the vibration drivers to have an optimum value in the amplitude, the direction, or the phase of vibration in accordance with an external requirement and thus to improve the quality of reproduced sounds.

The panel speaker may be added with the feeding back circuit to dynamically control the frequency characteristic of the sound emitted from the panel speaker to a desired level.

As described in each of the above embodiments of the present invention, each vibration driver is not mounted on a central portion of the acoustic vibrating plate. Thus, the central portion can be utilized as a free space. Accordingly, the down-sizing of a system using the panel speaker can be enabled through the effective use of the free space. Also, the shape of the panel speaker may be rectangular as described above or polygonal. In this case, the vibration drivers may be located at one of corners. Also, the application fields of the acoustic vibrating plate can be enlarged, permitting a variety of materials to be used for implementing the acoustic vibrating plate. For example, the acoustic vibrating plate 1 may be made of a light transmissive or transparent sheet member as the whole or partially in the panel speaker of any previous embodiments. In this case, the panel speaker can be easily used as a transparent and protective film for a picture frame speaker, a display, a shielding material, a window, and other subjects. Also, the panel speaker may be provided with a light reflection preventive film on the surface of the acoustic vibrating plate. In this case, the panel speaker can be favorably used for a display. In addition, when a light reflecting film is provided on the acoustic vibrating plate, the panel speaker can be applied to various types of mirror.

It would be appreciated that the present invention is not limited to the foregoing embodiments but any changes and modifications may be made without departing the technical spirit and scope of the present invention.

The panel speaker according to the present invention has each vibration driver mounted at the edge or the corner of the acoustic vibrating plate apart from the center of the acoustic vibrating plate. Therefore, the overall thickness can be reduced when the panel speakers are stored. As a result, the handling of the panel speaker or a system using the panel speaker can be made easier.

Also, when the acoustic vibrating plate is made of a light transparent material, the background can be viewed without prevention by the vibration driver. When the panel speaker is used as a picture frame speaker, the acoustic vibrating plate made of a transparent film can permit the photograph or picture behind to be viewed clearly. Moreover, the panel speaker can be used in a variety of applications with a display, a shielding, a window, and other subjects.

What is claimed is:

1. A panel speaker comprising:

an acoustic vibrating plate; and a vibration driver mounted off a center of said acoustic vibrating plate and applying vibration to said acoustic vibrating plate, wherein said vibration driver is located at or on an edge portion of said acoustic vibrating plate.

2. A panel speaker according to claim 1, wherein said vibration driver is located outside of a region defined by connecting intermediate points of lines extending between said center of said acoustic vibrating plate and edges of said acoustic vibrating plate.

3. A panel speaker according to claim 1, wherein said acoustic vibrating plate is formed to have substantially a polygonal shape, and said vibration driver is located at or adjacent to a corner of said acoustic vibrating plate.

4. A panel speaker comprising:

an acoustic vibrating plate; and a vibration driver mounted off a center of said acoustic vibrating plate and applying vibration to said acoustic vibrating plate, wherein said vibration driver is located outside of a region defined by connecting intermediate points of lines extending between said center of said acoustic vibrating plate and edges of said acoustic vibrating plate, wherein a direction of application of said vibration by the driver is a direction other than a direction perpendicular to a surface plane of said acoustic vibrating plate.

5. A panel speaker comprising:

an acoustic vibrating plate; and a vibration driver mounted off a center of said acoustic vibrating plate and applying vibration to said acoustic vibrating plate, wherein said acoustic vibrating plate has a transparent member provided at least locally thereon to allow a background to be viewed.

6. A panel speaker comprising:

an acoustic vibrating plate; and a vibration driver mounted off a center of said acoustic vibrating plate and applying vibration to said acoustic vibrating plate, wherein said acoustic vibrating plate has a transparent provided at least locally thereon to allow a background to be viewed, wherein said acoustic vibrating plate has a reflection protective film provided at least locally thereon to prevent reflection of incoming light.

7. A panel speaker comprising:

an acoustic vibrating plate; and a vibration driver mounted off a center of said acoustic vibrating plate and applying vibration to said acoustic vibrating plate, wherein said acoustic vibrating plate has a light reflective film at least locally thereon to reflect incoming light.

8. A panel speaker comprising:

an acoustic vibrating plate; and a plurality of vibration drivers mounted outside of a region defined by connecting intermediate points of lines extending between a center of said acoustic vibrating plate and edges of said acoustic vibrating plate, and applying vibration on said acoustic vibrating plate, wherein at least one of said plurality of vibration drivers is located at or on an edge portion of said acoustic vibrating plate.

9. A panel speaker according to claim 8, wherein said acoustic vibrating plate is formed to have substantially a polygonal shape, and at least one of said plurality of vibration drivers is located at or adjacent to one corner of said acoustic vibrating plate.

10. A panel speaker comprising:

an acoustic vibrating plate; and a plurality of vibration drivers mounted outside of a region defined by connecting intermediate points of lines extending between a center of said acoustic vibrating plate and edges of said acoustic vibrating plate, and applying vibration on said acoustic vibrating plate, wherein a direction of application of said vibration by at least one of said plurality of vibration drivers is a direction other than a direction perpendicular to a surface plane of said acoustic vibrating plate.

11. A panel speaker according to claim 8, wherein an amplitude of said vibration applied by at least one of said plurality of vibration drivers is different from an amplitude of said vibration applied by each of the remaining vibration drivers.

12. A panel speaker according to claim 8, wherein a direction of said vibration applied by at least one of said plurality of vibration drivers is different from direction of said vibration applied by each of the remaining vibration drivers.

13. A panel speaker comprising:

an acoustic vibrating plate; and a plurality of vibration drivers mounted outside of a region defined by connecting intermediate points of lines extending between a center of said acoustic vibrating plate and edges of said acoustic vibrating plate, and applying vibration on said acoustic vibrating plate, wherein a phase of said vibration applied by at least one of said plurality of vibration drivers is different from a phase of said vibration applied by each of the remaining vibration drivers.

14. A panel speaker comprising:

an acoustic vibrating plate; and a plurality of vibration drivers mounted outside of a region defined by connecting intermediate points of lines extending between a center of said acoustic vibrating plate and edges of said acoustic vibrating plate, and applying vibration on said acoustic vibrating plate, wherein said acoustic vibrating plate has a transparent member provided at least locally thereon to allow a background to be viewed.

15. A panel speaker comprising:

an acoustic vibrating plate; and a plurality of vibration drivers mounted outside of a region defined by connecting intermediate points of lines extending between a center of said acoustic vibrating plate and edges of said acoustic vibrating plate, and applying vibration on said acoustic vibrating plate, wherein said acoustic vibrating plate has a transparent member provided at least locally thereon to allow a background to be viewed, wherein said acoustic vibrating plate has a reflection preventing film provided at least locally thereon to prevent reflection of incoming light.

16. A panel speaker comprising:

an acoustic vibrating plate; and a plurality of vibration drivers mounted outside of a region defined by connecting intermediate points of lines extending between a center of said acoustic vibrating plate and edges of said acoustic vibrating plate, and applying vibration on said acoustic vibrating plate, wherein said acoustic vibrating plate has a light reflective film provided at least locally thereon to reflect incoming light.

17. A panel speaker comprising:

an acoustic vibrating plate;

a plurality of vibration drivers mounted outside of a region defined by connecting intermediate points of lines extending between a center of said acoustic vibrating plate and edges of said acoustic vibrating plate and applying vibration on said acoustic vibrating plate; and a control unit controlling at least one of said plurality of vibration drivers.

18. A panel speaker according to claim 17, wherein said control unit controls an amplitude of said vibration applied by said at least one vibration driver.

19. A panel speaker according to claim 17, wherein said control unit controls said plurality of vibration drivers to control propagation of vibration in said acoustic vibrating plate.

20. A panel speaker comprising:

an acoustic vibrating plate;

a plurality of vibration drivers mounted outside of a region defined by connecting intermediate points of lines extending between a center of said acoustic vibrating plate and edges of said acoustic vibrating plate and applying vibration on said acoustic vibrating plate; and a control unit controlling at least one of said plurality of vibration drivers, wherein said control unit controls a phase of said vibration applied by said at least one vibration driver.

21. A panel speaker comprising:

an acoustic vibrating plate;

a plurality of vibration drivers mounted outside of a region defined by connecting intermediate points of lines extending between a center of said acoustic vibrating plate and edges of said acoustic vibrating plate and applying vibration on said acoustic vibrating plate; and a control unit controlling at least one of said plurality of vibration drivers, wherein said acoustic vibrating plate has a transparent member provided at least locally thereon to allow a background to be viewed.

22. A panel speaker according to claim 21, wherein said acoustic vibrating plate has a reflection preventing film provided at least locally thereon to prevent reflection of incoming light.

23. A panel speaker comprising:

an acoustic vibrating plate;

a plurality of vibration drivers mounted outside of a region defined by connecting intermediate points of lines extending between a center of said acoustic vibrating plate and edges of said acoustic vibrating plate and applying vibration on said acoustic vibrating plate; and a control unit controlling at least one of said plurality of vibration drivers, wherein said acoustic vibrating plate has a light reflective film provided at least locally thereon to reflect incoming light.

* * * * *